US011142009B2

(12) United States Patent
Maruyama

(10) Patent No.: US 11,142,009 B2
(45) Date of Patent: Oct. 12, 2021

(54) CLEANING DEVICE AND INK JET RECORDING APPARATUS

(71) Applicant: KYOCERA Document Solutions Inc., Osaka (JP)

(72) Inventor: Kei Maruyama, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/064,774

(22) Filed: Oct. 7, 2020

(65) Prior Publication Data

US 2021/0129561 A1 May 6, 2021

(30) Foreign Application Priority Data

Oct. 31, 2019 (JP) ..... JP2019-198355

(51) Int. Cl.
*B41J 29/17* (2006.01)

(52) U.S. Cl.
CPC ..... *B41J 29/17* (2013.01)

(58) Field of Classification Search
CPC ..... B41J 29/17; B41J 11/007; B41J 13/002
See application file for complete search history.

(56) References Cited

U.S. PATENT DOCUMENTS

2007/0195145 A1* 8/2007 Yamashita ..... B41J 29/17 347/101
2017/0113476 A1* 4/2017 Hara ..... B41J 29/17

FOREIGN PATENT DOCUMENTS

JP 2005-134726 5/2005

* cited by examiner

*Primary Examiner* — Scott A Richmond
(74) *Attorney, Agent, or Firm* — Lex IP Meister, PLLC

(57) ABSTRACT

A cleaning unit includes a pressing roller for pressing a web for removing ink adhering to a conveying surface of a resist roller that conveys a sheet on which the ink has been discharged, against the conveying surface. A cleaning liquid supply unit supplies a cleaning liquid to an unused portion of the web. A web drive mechanism supplies the unused portion of the web to the nip region between the pressing roller and the conveying surface. A controller supplies the unused portion to which the cleaning liquid has been supplied by the cleaning liquid supply unit to the nip region by using the web driving mechanism thereby removing the ink from the conveying surface, and subsequently supplies the unused portion to which the cleaning liquid has not been supplied to the nip region by the web driving mechanism thereby removing the cleaning liquid remaining on the conveying surface.

4 Claims, 12 Drawing Sheets

1
10
11
12
15
16
17
18
19
21
22
23 (23b)
23 (23a)
24
25
26
27
30
32
33
41
42Bk
42Y
42M
42C
44
45
46a
46b
46c
46d
46e
47
50
51
52a
52b
53
54
55
56
60
S
Y1
Y2
Y3
Y4
Y5
Y6
N1
U
L
R
Lo

CLEANING DEVICE AND INK JET RECORDING APPARATUS

This application is based upon and claims the benefit of priority from the corresponding Japanese Patent Application No. 2019-198355 filed on Oct. 31, 2019, the entire contents of which are incorporated herein by reference.

BACKGROUND

The present disclosure relates to a cleaning device and an ink jet recording apparatus.

In a typical image forming apparatus such as a printer, a foreign substance such as a coloring material or paper dust may adhere to a member and cause a problem. Therefore, a technique of cleaning the surface of a member has been studied. For example, the conveyance transfer belt unit, which is detachably attached to the main body of the typical image forming apparatus and to which the photo sensor is attached, includes a cleaning arm swingably attached to the frame of the unit, and a cleaning member provided to the cleaning arm and capable of cleaning the surface of the photo sensor. When the unit is attached to the main body of the image forming apparatus, the sensor cleaning mechanism positions the cleaning arm at the retracted position where the cleaning member is retracted from the surface of the photo sensor, and is positioned to cover the surface of the photo sensor when the unit is removed from the main body of the typical image forming apparatus.

In a typical ink jet recording apparatus, if ink adheres to the conveying surface (surface in contact with the sheet) of the conveying member (conveying roller, conveying belt, etc.) for conveying the sheet, ink may transfer from the conveying surface to the subsequent sheet, thereby causing image contamination. In particular, since the resist roller has a high nip pressure, even if a material having good water repellency is used for the surface, ink tends to adhere to the resist roller. Therefore, a configuration in which the ink is removed by pressing a cloth against the conveying surface can be considered, but a dry cloth has less ability to remove the ink. If a wet cloth is used, the ability to remove the ink is improved, but if moisture remaining on the conveying surface adheres to the sheet, there is a possibility of occurrence of problems such as bleeding of an image and wrinkles of the sheet. A configuration in which the moisture remaining on the conveying surface is removed with a dry cloth is also conceivable, but this causes the ink jet recording apparatus to become more complicated and larger in size.

SUMMARY

A cleaning device according to an aspect of the present disclosure includes a cleaning unit, a cleaning liquid supply unit, a web driving mechanism, and a controller. The cleaning unit includes a web pressing section for pressing a web for removing an ink adhering to a conveying surface of a conveying member that conveys a sheet on which the ink has been discharged, against the conveying surface. The cleaning liquid supply unit supplies a cleaning liquid to an unused portion. The web driving mechanism supplies the unused portion of the web to a nip region between the web pressing section and the conveying surface. The controller removes the ink from the conveying surface by supplying the unused portion to which the cleaning liquid has been supplied by the cleaning liquid supply unit to the nip region by using the web driving mechanism. Subsequently, the controller supplies the unused portion to which the cleaning liquid has not been supplied to the nip region by using the web driving mechanism, thereby removing the cleaning liquid remaining on the conveying surface.

DETAILED DESCRIPTION

Hereinafter, a cleaning device 60 and a printer 1 (ink jet recording apparatus) according to an embodiment of the present disclosure will be described with reference to the drawings.

Figure 1:
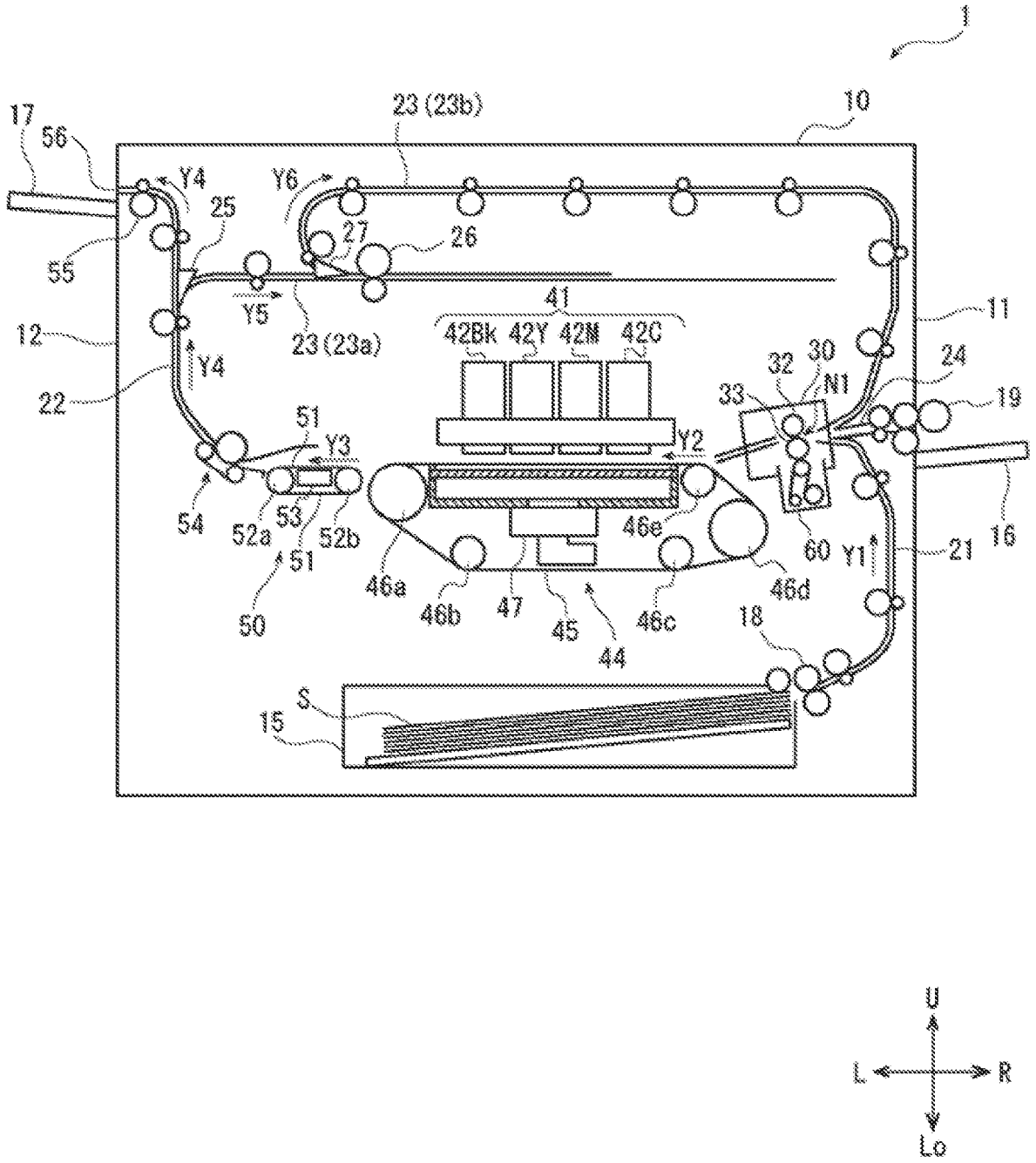
FIG. 1 is a front view schematically showing an internal configuration of a printer according to an embodiment of the present disclosure.

First, the entire configuration of the printer 1 will be described with reference to FIG. 1. FIG. 1 is a front view schematically showing the internal configuration of the printer 1. Hereinafter, the side which is near to readers, of the paper in which FIG. 1 is drawn, is defined to be the front (front side) of the printer 1, and the left and right directions are defined with reference to the direction of the printer 1 as viewed from the front side. In each figure, U, Lo, L, R, Fr, and Rr denote the top, bottom, left, right, front, and rear, respectively. In the following description, the upstream side and the downstream side mean the upstream side and the downstream side in the conveying direction of the sheet S, respectively.

As shown in FIG. 1, the printer 1 is an ink jet image forming apparatus for forming an image on a sheet S by discharging ink, and is capable of performing single-sided printing and double-sided printing on the sheet S. The printer 1 includes a box-shaped housing 10 in which various devices are accommodated. A sheet feeding cassette 15 in which sheets S are accommodated and which can be pulled out is provided in a lower portion of the housing 10, and a manual feed tray 16 in which sheets S are manually stacked is provided on the right side surface 11 of the housing 10. A discharge tray 17 on which sheets S on which images are formed are stacked is provided on the upper part of the left side surface 12 of the housing 10, and a discharge port 56 through which sheets S are discharged is formed on the upper part of the discharge tray 17 on the left side surface 12. The sheet S is a single sheet such as plain paper or coated paper.

An image forming section 41 for forming an image on a sheet S is provided in the center of the housing 10, a first transport unit 44 for transporting the sheet S on which an image is formed is provided below the image forming section 41, and a second transport unit 50 for transporting the sheet (S) on which an image has been formed is provided to the left of the first transport unit 44.

A first conveying path 21 extending from the paper feed cassette 15 to the first conveying unit 44 and a manual conveying path 24 joining the first conveying path 21 from the manual feed tray 16 are formed in the right side portion of the housing 10. A second conveying path 22 extending from the second conveying unit 50 to the discharge tray 17 is formed in the left side of the housing 10. A third conveying path 23 branched from the second conveying path 22 and joined to the first conveying path 21 is formed in the upper portion of the housing 10.

A paper feed section 18 is provided at the upstream end of the first conveying path 21, and a resist roller device 30 is provided at the downstream side of the paper feed section 18 of the first conveying path 21. The sheet feeding unit 18 includes rollers for feeding sheets S accommodated in the sheet feeding cassette 15 to the first conveying path 21, one by one. A resist roller device 30 includes a pair of resist rollers 32, and 33 facing up and down. The pair of resist rollers 32 and 33 come into contact with each other to form a nip region N1 where the sheet S is held.

The manual conveying path 24 joins the first conveying path 21 between the paper feed section 18 and the resist roller device 30. A manual feed unit 19 is provided at the upstream end of the manual conveying path 24. The manual feed unit 19 includes rollers for feeding sheets S stacked on the manual feed tray 16 to the manual conveying path 24, one by one.

The image forming section 41 includes a plurality of line heads 42C, 42M, 42Y, and 42 Bk (collectively referred to as line heads 42) for discharging inks of different colors, which are arranged in the conveying direction of the sheet S. The line heads 42 are formed in a box shape having a width direction (front-rear direction) intersecting the conveying direction of the sheet S as a longitudinal direction, and a large number of nozzle holes are formed in the respective lower surfaces. The line heads 42C, 42M, 42Y, and 42 Bk are provided in order from the upstream side in the conveying direction of the sheet S, and cyan, magenta, yellow, and black inks are discharged, respectively.

The first conveying unit 44 includes a first conveying belt 45 that is wound around a plurality of stretching rollers 46*a* to 46*e*. When the stretching roller 46*a* is driven by a driving source (not shown) such as a motor, the first conveying belt 45 is driven in the Y2 direction. A large number of through holes are formed in the first conveying belt 45. A first suction section 47 for generating a negative pressure in the through hole of the first conveying belt 45 is provided at a position facing the image forming section 41 inside the first conveying belt 45.

The second conveying unit 50 includes a second conveying belt 51 wound around a plurality of stretching rollers 52*a* and 52*b*. When the tension roller 52*a* is driven by a driving source (not shown) such as a motor, the second conveying belt 51 runs in the Y3 direction. A large number of through holes are formed in the second conveying belt 51. A second suction portion 53 for generating a negative pressure in the through hole of the second conveying belt 51 is provided in an upper portion inside the second conveying belt 51.

A decurling device 54 is provided at the upstream end of the second conveying path 22, and a paper discharge section 55 is provided at the downstream end of the second conveying path 22. The decurling device 54 includes a belt wound around a plurality of rollers and a roller in contact with the belt, and is driven by a drive source (not shown) such as a motor. The sheet discharge section 55 includes rollers for discharging the sheet S from the second conveying path 22 to the sheet discharge tray 17. A guide member 25 is provided between the upstream end and the downstream end of the second conveying path 22. The guide member 25 is a wedge-shaped member that swings by a driving source (not shown) such as a motor, and closes either the second conveying path 22 or the third conveying path 23.

The third conveying path 23 includes an upstream conveying path 23*a* branched from the second conveying path 22 and a downstream conveying path 23*b* branched from the upstream conveying path 23*a* and joined to the first conveying path 21 on the upstream side of the resist roller device 30, and includes a reversing roller 26 and a guide member 27 at the branch point between the upstream conveying path 23*a* and the downstream conveying path 23*b*. The reversing roller 26 can rotate in the forward direction and in the reverse direction. The guide member 27 is a wedge-shaped member that is swung by a driving source (not shown) such as a motor, and closes either the upstream conveying path 23*a* or the downstream conveying path 23*b*.

Next, an image forming operation of the printer 1 will be described. When an image forming instruction is input to the printer 1, the sheet S is fed from the sheet feeding cassette 15 or the manual feed tray 16, and is transported in the Y1 direction along the first conveying path 21. When the sheet S reaches the resist roller device 30, the leading end (downstream end) of the sheet S abuts against the nip region N1 of the resist roller device 30 in which the rotation is stopped, thereby correcting the skew of the sheet S, and the sheet S is transferred from the resist roller device 30 to the first conveying unit 44 in synchronization with the ink discharge timing by the image forming section 41. The sheet S is attracted to the first conveying belt 45 by the negative pressure in the through hole of the first conveying belt 45, and is conveyed in the Y2 direction. Then, ink is discharged from the line heads 42 toward the sheet S attracted to the first conveying belt 45, thereby forming an image on the first side of the sheet S.

The sheet S on which the image is formed on the first side is conveyed by the first conveying unit 44 to the second conveying unit 50, is attracted to the second conveying belt 51 by the negative pressure in the through hole of the second conveying belt 51, and is conveyed in the Y3 direction. Subsequently, the sheet S is conveyed to the decurling device 54, and is nipped and conveyed by the decurling device 54 to correct the curl. In the single-sided printing operation, the sheet S is conveyed along the second conveying path 22 in the Y4 direction by the guide member 25 closing the third conveying path 23, and the sheet S is discharged to the discharge tray 17 by the discharge section 55.

On the other hand, in the double-sided printing operation, the sheet S is guided to the third conveying path 23 by the guide member 25 closing the second conveying path 22, and the sheet S is conveyed in the Y5 direction by the guide member 27 closing the downstream-side conveying path 23*b* and the reverse roller 26 rotating in the forward direction. When the left end of the sheet S reaches the reversing roller 26, the guide member 27 closes the upstream-side conveying path 23*a*, and the reversing roller 26 rotates reversely, so that the sheet S is switched back to the downstream-side conveying path 23*b* and conveyed in the Y6 direction. Then, the sheet S is conveyed to the resist roller device 30 in a state where the sheet S is upside down. After the skew of the sheet S is corrected by the resist roller device 30, the sheet S is transported to the first conveying unit 44, and an image is formed on the second side of the sheet S. The sheet S on which the image is formed on the second side is conveyed in the Y3 direction by the second conveying unit 50, the curl thereof is corrected by the decurling device 54, the sheet S is conveyed in the Y4 direction along the second conveying path 22, and the sheet S is discharged from the discharge port 56 to the discharge tray 17 by the discharge section 55.

In the double-sided printing operation, after an image is formed on the first side, the sheet S is conveyed to the resist roller device 30 via the third conveying path 23 with the first side facing downward. At this time, there is a possibility that the ink on the first side adheres to the lower resist roller 33 (one example of the conveying member), and the adhered ink is transferred to the subsequent sheet S to cause image stain. Therefore, the printer 1 according to the present embodiment is configured to remove the ink adhering to the resist roller 33 by the cleaning device 60. The above-described image stain is likely to occur in the case of a pigment-based ink in which a coloring material is relatively likely to remain on the sheet. Therefore, the use of the pigment based ink is assumed in this embodiment; however, the present disclosure may be applied to an ink jet recording apparatus using the dye based ink.

Figure 2:
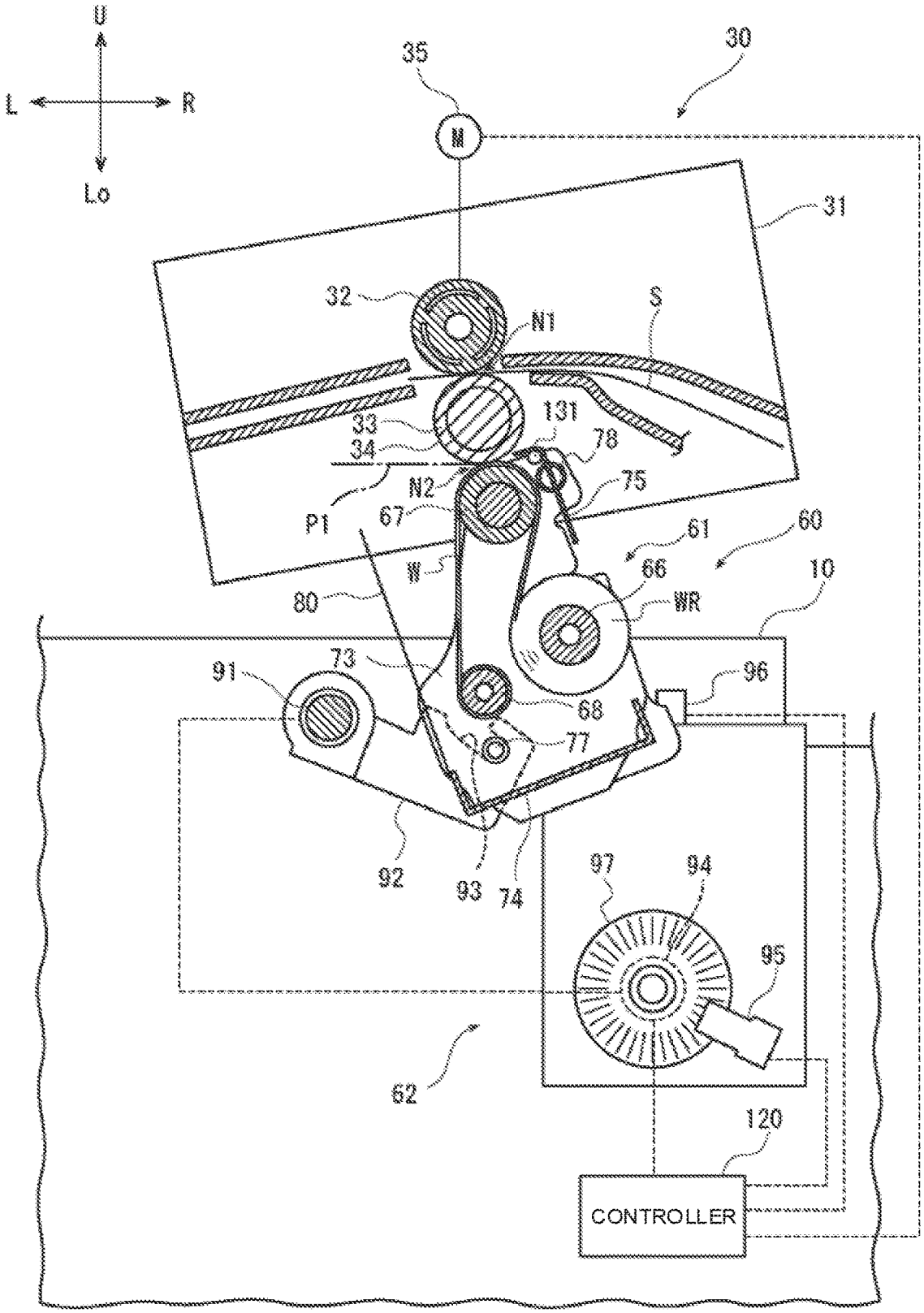
FIG. 2 is a front view schematically showing a configuration of a resist roller device, a cleaning unit, and a unit moving mechanism according to an embodiment of the present disclosure.
Figure 3:
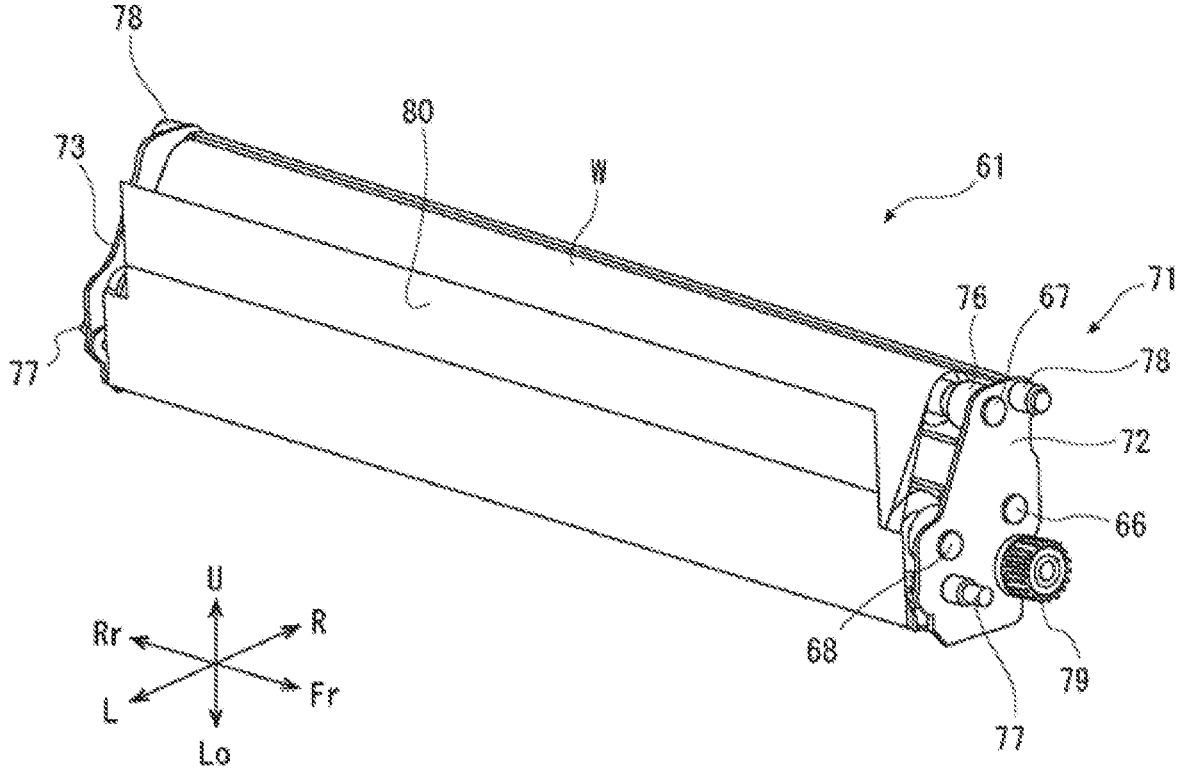
FIG. 3 is a perspective view of a cleaning unit according to an embodiment of the present disclosure.
Figure 4:
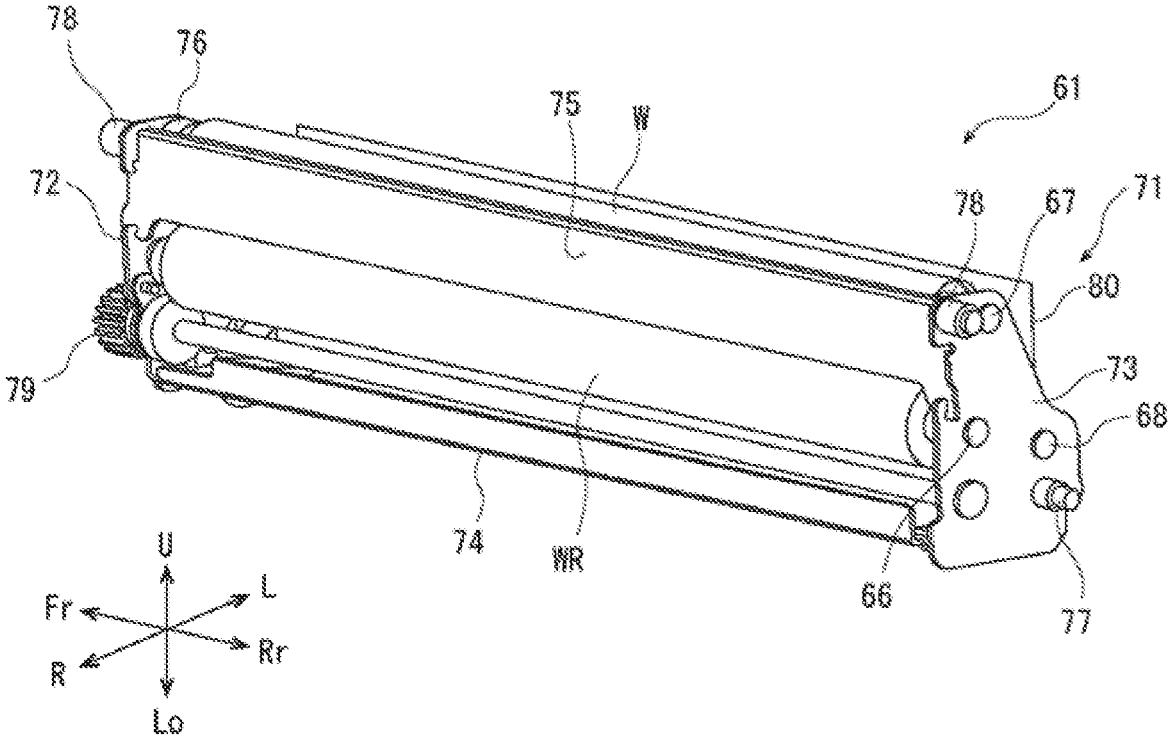
FIG. 4 is a perspective view of a cleaning unit according to an embodiment of the present invention.
Figure 5:
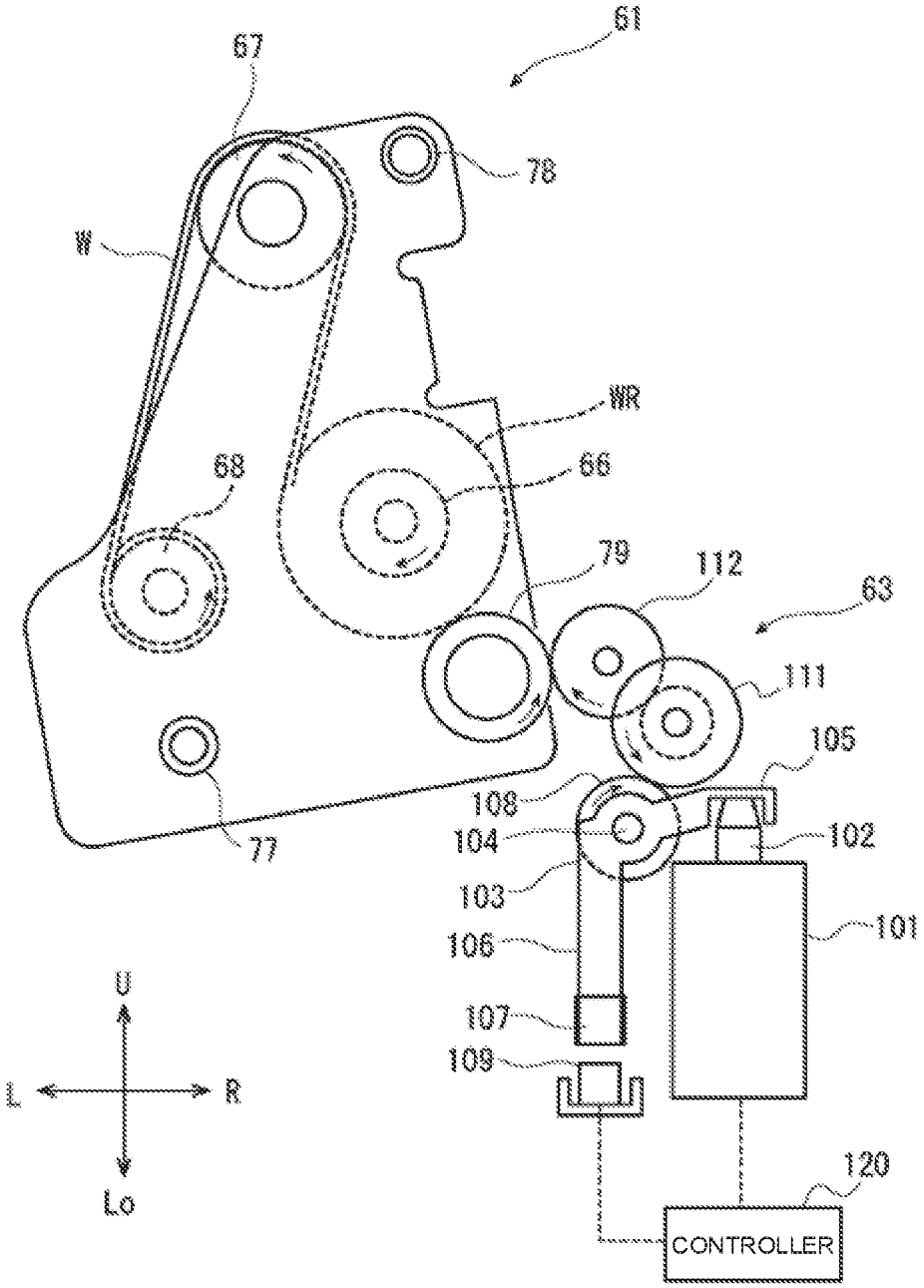
FIG. 5 is a front view of a cleaning unit and a web driving mechanism according to an embodiment of the present disclosure.
Figure 6:
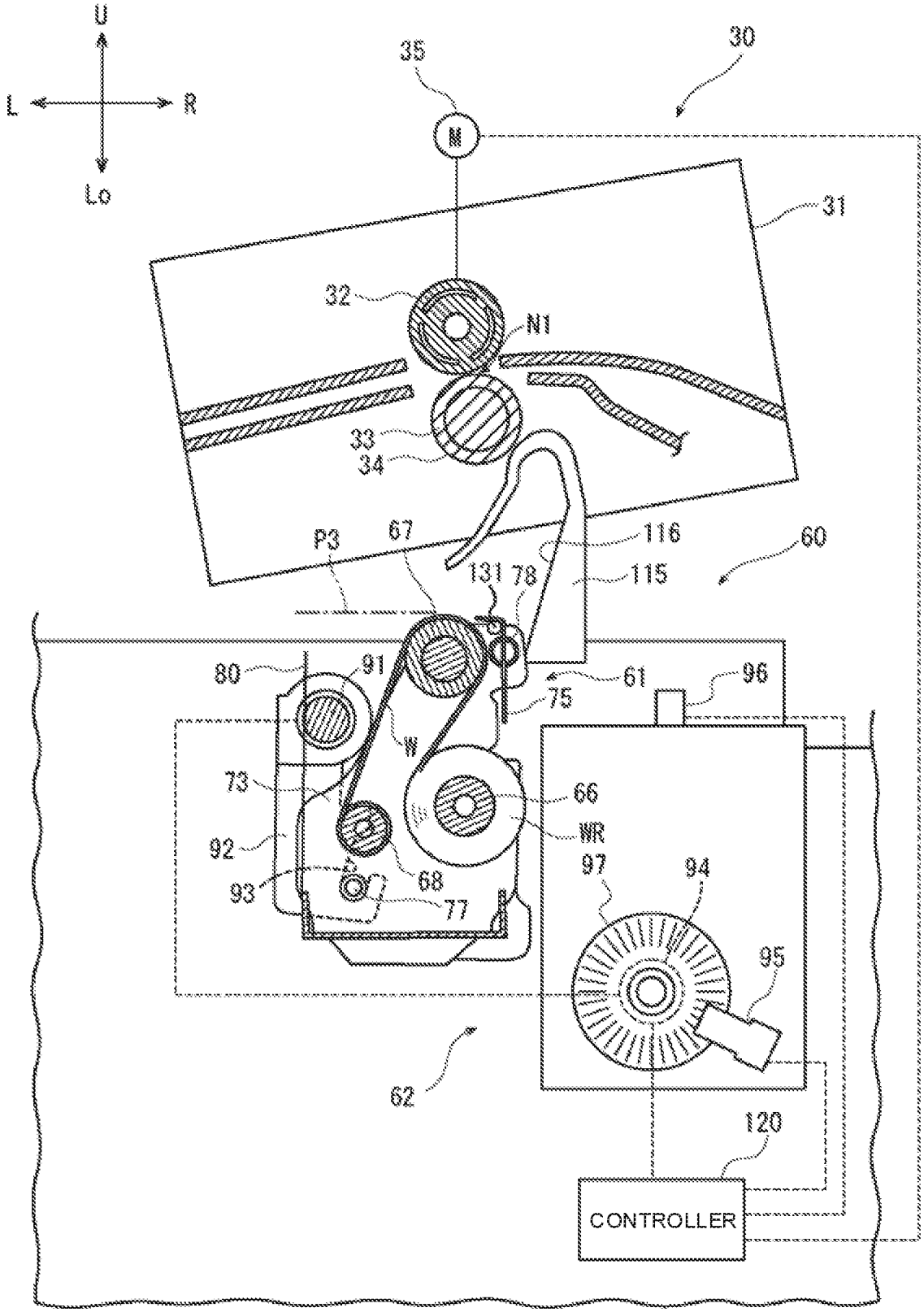
FIG. 6 is a front view showing a state in which the cleaning unit is positioned in the attaching/detaching position.
Figure 7:
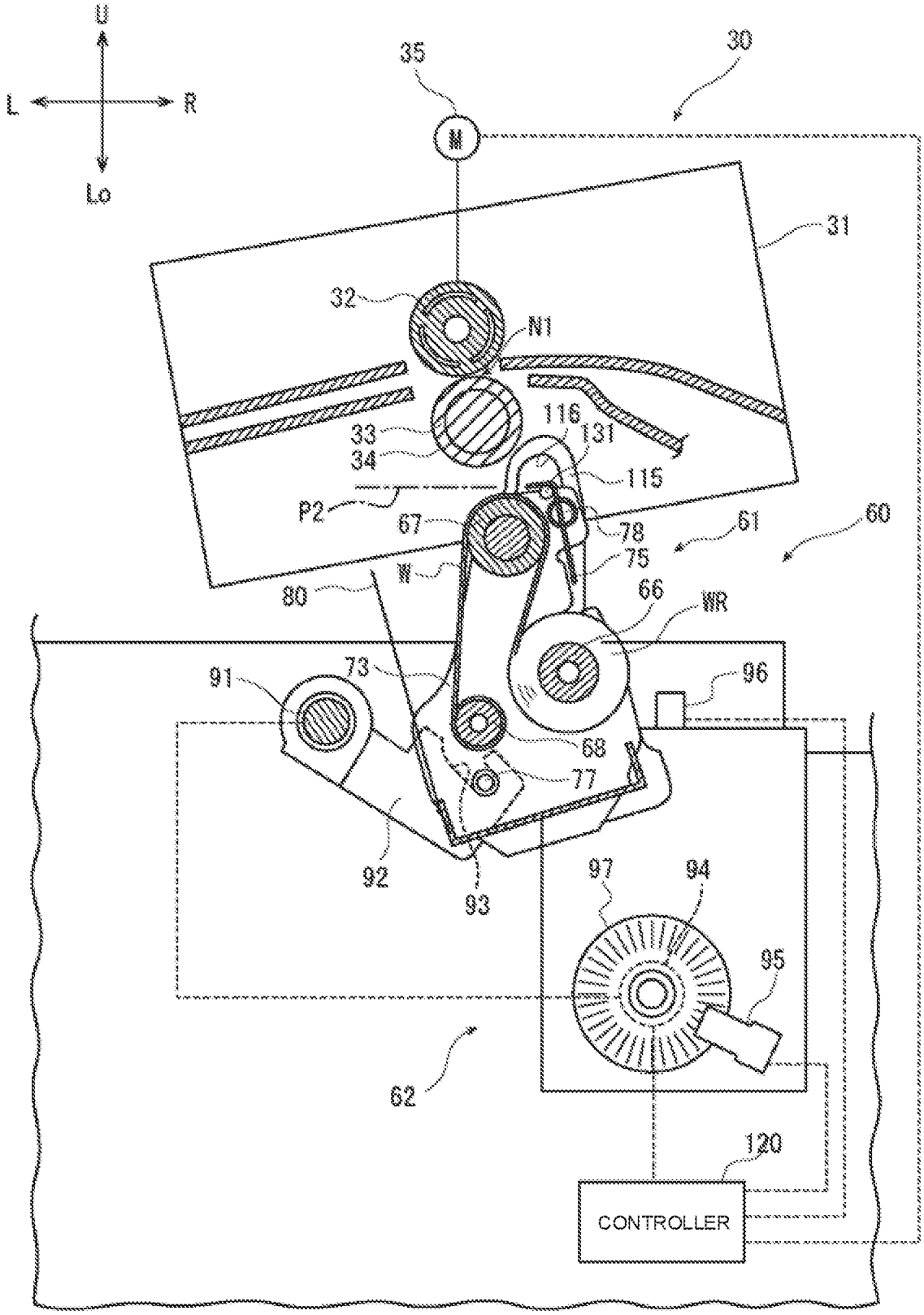
FIG. 7 is a front view showing a state in which the cleaning unit is positioned at the separation position.
Figure 8:
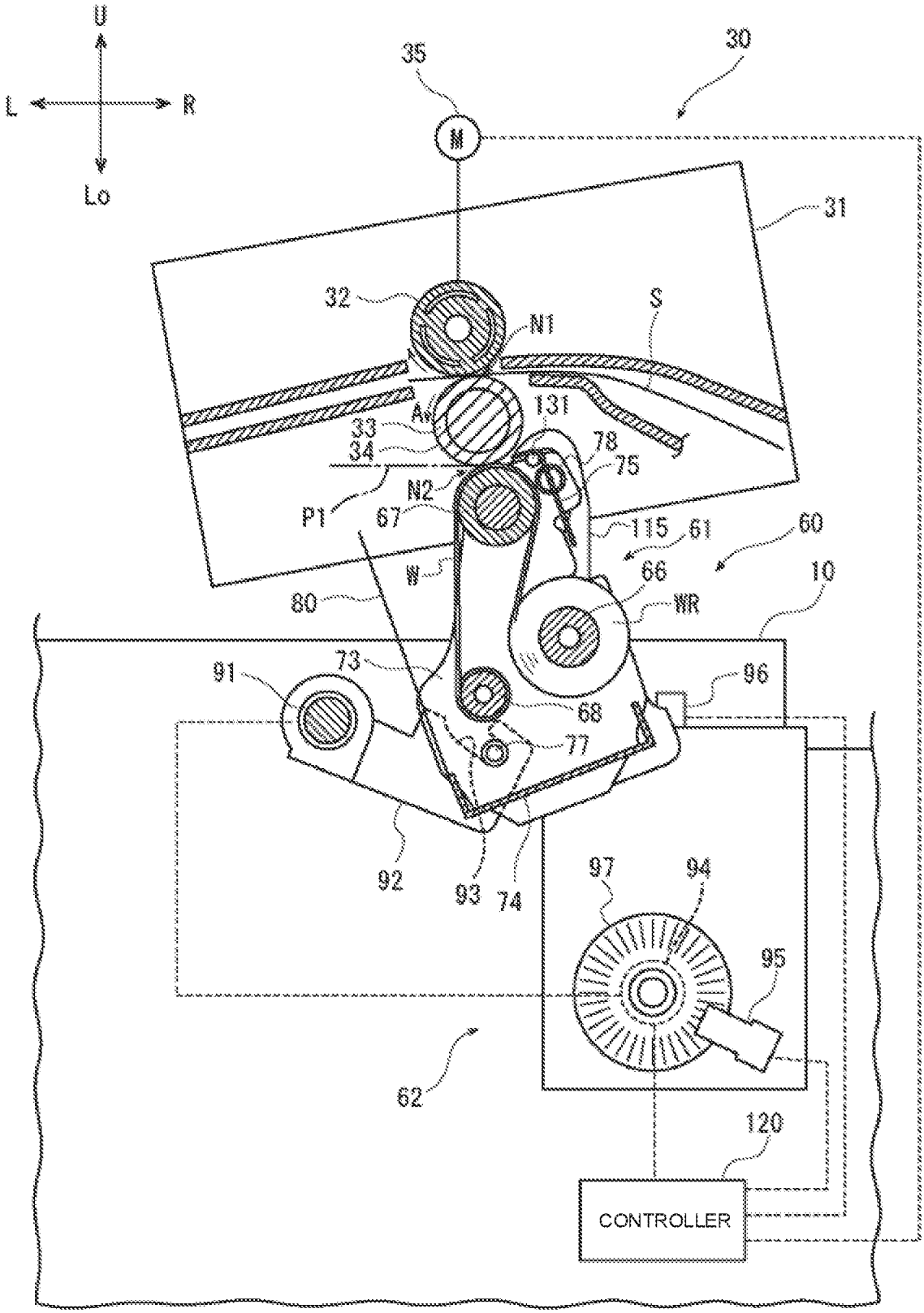
FIG. 8 is a front view showing a state in which the cleaning unit is positioned at the cleaning position.
Figure 9:
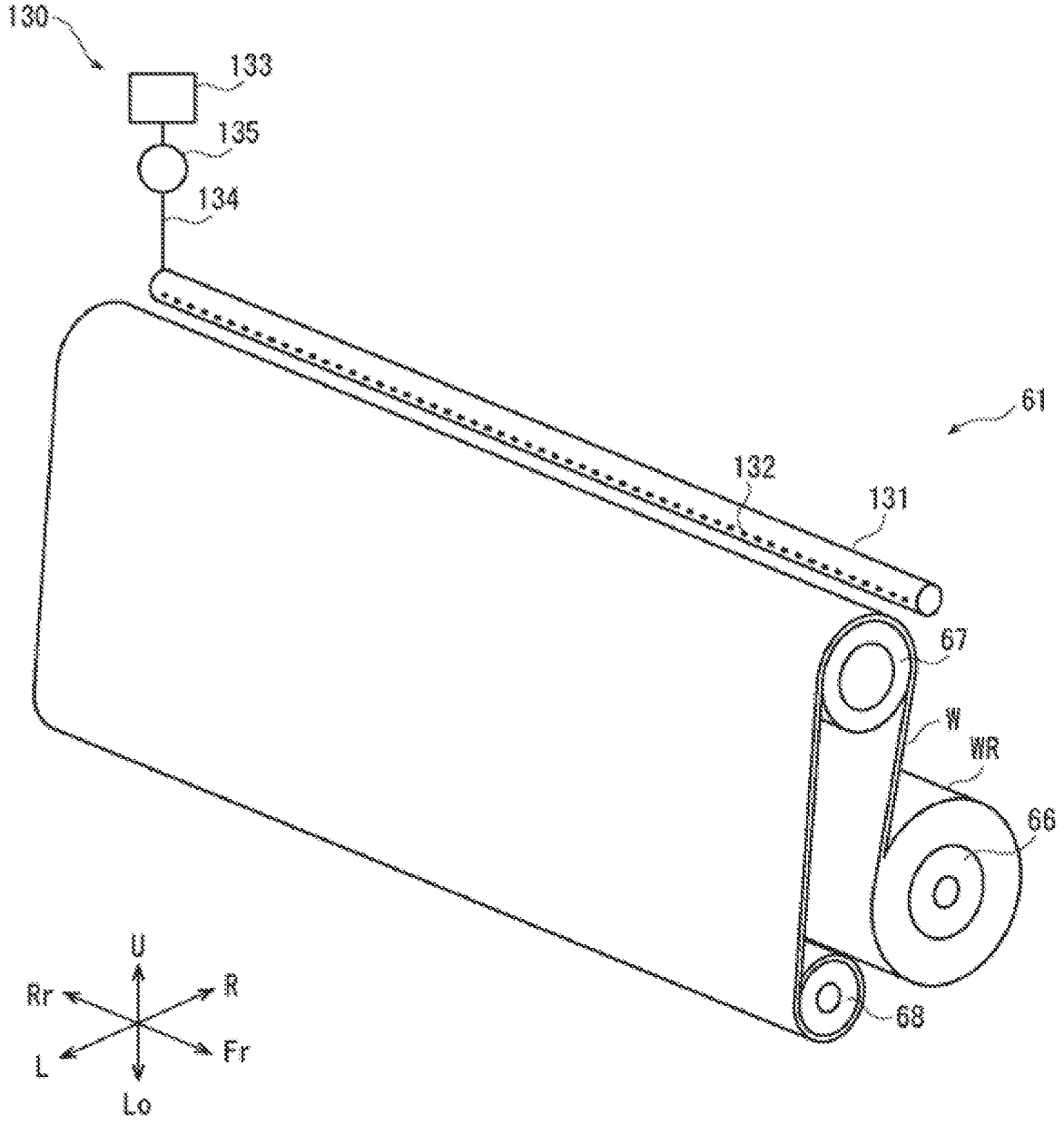
FIG. 9 is a perspective view of a cleaning liquid supply unit and a web according to an embodiment of the present disclosure.
Figure 10A:
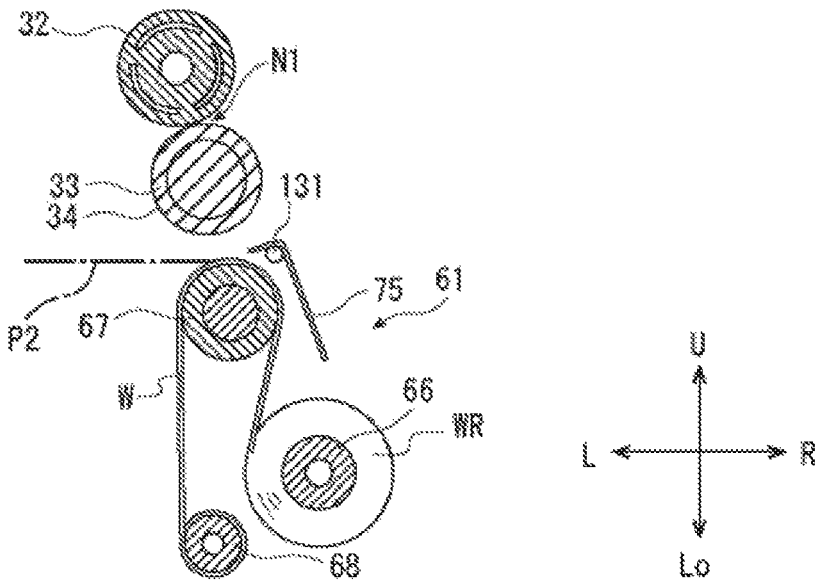
FIG. 10A is a front view showing a procedure for controlling the cleaning device.
Figure 10B:
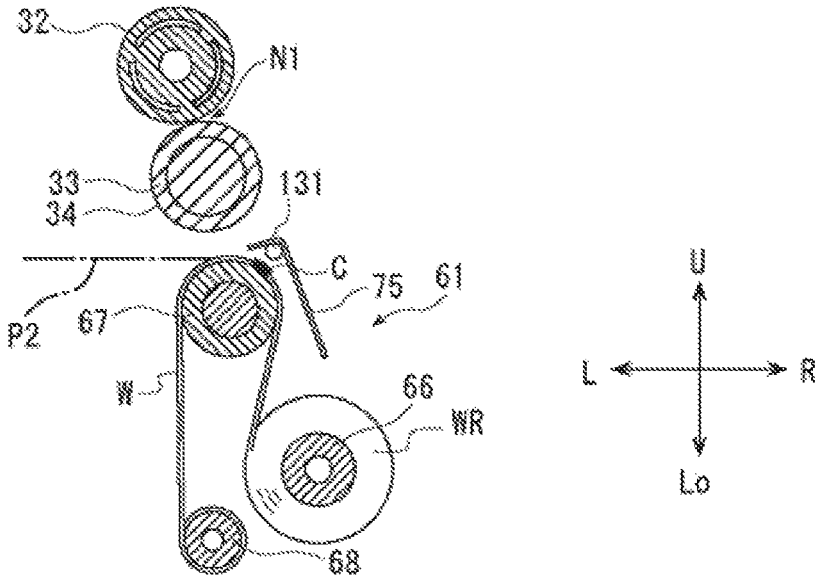
FIG. 10B is a front view showing a procedure for controlling the cleaning device.

The resist roller device 30 and the cleaning device 60 will be described below with reference to FIGS. 2 to 9. FIG. 2 is a front view schematically showing the configuration of the resist roller device 30, the cleaning unit 61, and the unit moving mechanism 62. FIGS. 3 and 4 are perspective views of the cleaning unit 61. FIG. 5 is a front view of the cleaning unit 61 and the web driving mechanism 63. FIG. 6 is a front view showing the state in which the cleaning unit 61 is positioned at the attachment/detachment position P3. FIG. 7 is a front view showing a state in which the cleaning unit 61 is positioned at the separation position P2. FIG. 8 is a front view showing a state in which the cleaning unit 61 is positioned at the cleaning position P1. FIG. 9 is a perspective view of the cleaning liquid supply unit 130 and the web W.

[Controller]

The resist roller device 30 and the cleaning device 60 are controlled by a controller 120. The controller 120 may be realized by software using a processor, or may be realized by a logic circuit (hardware) formed in an integrated circuit or the like. When a processor is used, various processes are performed by the processor reading and executing programs stored in the memory. As the processor, for example, a CPU (Central Processing Unit) is used. The memory includes a storage medium such as a ROM (Read Only Memory), a RAM (Random Access Memory), and an EEPROM (Electrically Erasable Programmable Read Only Memory). A control program used for controlling each part of the printer 1 is stored in the memory.

[Resist Roller Device]

The resist roller device 30 (see FIG. 2) has a resist housing 31 in which a conveying path for the sheet S is formed. The pair of resist rollers 32 and 33 are arranged with the front-rear direction as the axial direction, and are supported on the front and rear side walls of the resist housing 31. The upper resist roller 32 is made of metal. The lower resist roller 33 is a rubber roller covered with a PFA (4 fluorinated ethylene/perfluoroalkoxy ethylene copolymer resin) tube. The lower resist roller 33 is positioned slightly on the upstream side (right side) of the upper resist roller 32 in the conveying direction of the sheet S.

When the resist roller 32 is pressed against the resist roller 33 by a biasing means (not shown) such as a spring, the conveying surface 34 of the resist roller 33 is partially deformed and comes into surface contact with the resist roller 32 to form a nip region N1. A registration motor 35 is connected to the resist roller 32 or the resist roller 33 via a power transmission mechanism (not shown). The sheet S is sandwiched between the pair of resist rollers 32 and 33 in the nip region N1, and the pair of resist rollers 32 and 33 are rotated by the driving force of the registration motor 35, whereby the sheet S is conveyed toward the image forming section 41 (see FIG. 1).

[Cleaning Device]

The cleaning device 60 (see FIG. 2) is provided below the resist roller device 30. The cleaning device 60 includes a cleaning unit 61, a cleaning liquid supply unit 130, a unit moving mechanism 62, and a web driving mechanism 63. The cleaning unit 61 includes a pressing roller 67 (an example of a web pressing section) for pressing the web W for removing the ink adhering to the conveying surface 34 of the resist roller 33 (an example of a conveying member) for conveying the sheet S on which the ink has been discharged, against the conveying surface 34. The cleaning liquid supply unit 130 supplies the cleaning liquid C to the unused portion of the web W. The cleaning unit 61 is moved to a cleaning position P1 where the web W is pressed against the unit moving mechanism 62 and the conveying surface 34, and to a separation position P2 where the web W is separated from the conveying surface 34. The web driving mechanism 63 supplies the unused portion of the web W to the nip region N2 between the pressing roller 67 and the conveying surface 34.

Specifically, the cleaning device 60 includes a cleaning unit 61 (see FIGS. 2 to 5) which is detachable from the housing 10, a unit moving mechanism 62 (see FIG. 2) fixed to the housing 10, and a web driving mechanism 63 (see FIG. 5). When the cleaning unit 61 is attached to the housing 10, the unit moving mechanism 62 and the web driving mechanism 63 are connected to the cleaning unit 61. The cleaning unit 61 is moved in the vertical direction by the unit moving mechanism 62, and the unused portion of the web W is fed out by the web driving mechanism 63.

[Cleaning Unit]

The cleaning unit 61 includes a feeding roller 66 for feeding out the web W, a pressing roller 67 for pressing the web W against the conveying surface 34, and a winding roller 68 for winding the web W.

As shown in FIGS. 3 and 4, the cleaning unit 61 includes a cleaning frame 71 having a shape having a longitudinal direction in the front-rear direction as a whole. The cleaning frame 71 includes a pair of support frames 72, 73 facing in the front-rear direction, a lower frame 74 connecting the lower parts of the pair of support frames 72, 73, and a side frame 75 connecting the right parts of the pair of support frames 72, 73.

As shown in FIGS. 2 to 4, both front and rear end portions of the feeding roller 66 are supported on the lower right portion of the pair of support frames 72 and 73. The front and rear end portions of the pressing roller 67 are supported on the upper portion of the pair of support frames 72 and 73. The front and rear end portions of the winding roller 68 are supported on the lower left portion of the pair of support frames 72 and 73. The feeding roller 66, the pressing roller 67, and the winding roller 68 are supported by a pair of support frames 72 and 73, and the pair of support frames 72 and 73 are connected by the lower frame 74 and the side frame 75, so that the rigidity of the cleaning frame 71 is ensured. The upper portion of the cleaning frame 71 is open, and the web W wound around the pressing roller 67 is exposed.

[Web]

The web W is formed of a belt-like material such as a nonwoven fabric or a woven fabric having water absorbency. A web roll WR in which a web W is wound in a roll shape is mounted on the outer peripheral surface of the feeding roller 66, the web W fed from the web roll WR is wound on the outer peripheral surface of the pressing roller 67, and the tip of the web W is fixed to the outer peripheral surface of the winding roller 68. The web W is pressed against the conveying surface 34 of the lower resist roller 33 by the pressing roller 67.

The pressing roller 67 includes a core, an elastic layer formed on the outer peripheral surface of the core, and a coat layer formed on the outer peripheral surface of the elastic layer. The core is made of a metal such as an aluminum alloy. The elastic layer is formed of an elastic material such as rubber. The coat layer is formed of a tube of fluororesin such as PFA. When the pressing roller 67 is pressed against the resist roller 33, the outer peripheral surfaces of the resist roller 33 and the pressing roller 67 are partially deformed, and the web W and the conveying surface 34 of the resist roller 33 are brought into surface contact with each other to form a nip region N2.

The shaft of the pressing roller 67 includes a torque limiter 76 (see FIGS. 3 and 4). In the case where the sheet S is jammed while being held between the pair of resist rollers 32 and 33, the sheet S needs to be pulled out in the right direction in FIG. 2, but when the sheet S is pulled out, the pressing roller 67 is rotated counterclockwise in FIG. 2 due to friction with the sheet S, and the web W is pulled out from the feeding roller 66. When an excessive rotational force is transmitted to the pressing roller 67, the torque limiter 76 prevents the web W from being fed out from the feeding roller 66 by locking the pressing roller 67.

A support pin 77 connected to the unit moving mechanism 62 (see FIG. 2) is provided on the outer surface of the lower left portion of the pair of support frames 72 and 73. A guide roller 78 for guiding the movement of the cleaning unit 61 with respect to the housing 10 is provided on the outer surface of the upper right portion of the pair of support frames 72 and 73. An input gear 79 connected to the web driving mechanism 63 (see FIG. 5) is provided in the lower right portion of the front support frame 72. The input gear 79 is connected to the winding roller 68 via a power transmission mechanism (not shown) provided in the cleaning frame 71.

The lower frame 74 forms the bottom surface of the cleaning frame 71, and serves as a receptacle for ink dropped from the web W or the like. The side frame 75 covers the upper half of the right side surface of the cleaning frame 71, and the lower half of the right side surface of the cleaning frame 71 is open. By visually confirming the web roll WR from the opening on the right side, it is possible to prevent the cleaning unit 61 having a small residual amount of the web roll WR from being erroneously mounted on the housing 10. A sheet member 80 is attached to the lower frame 74 to cover the left side surface of the cleaning frame 71 so as to prevent ink from scattering toward the first conveying belt 45 (see FIG. 1).

[Cleaning Liquid Supply Unit]

The cleaning liquid supply unit 130 (see FIG. 9) includes a discharge pipe 131 in which a nozzle 132 for discharging the cleaning liquid C onto an unused portion of the web W is formed, a tank 133 for containing the cleaning liquid C, a pipe path 134 connecting the tank 133 and the discharge pipe 131, and a pump 135 for feeding the cleaning liquid C from the tank 133 to the discharge pipe 131.

The discharge pipe 131 is a pipe arranged in parallel with the pressing roller 67 on the upper right side of the pressing roller 67, and is formed of metal, resin, or the like. The length of the discharge pipe 131 in the front-rear direction is equal to the length of the conveying surface 34 of the resist roller 33 in the front-rear direction. Both ends of the discharge pipe 131 in the front-rear direction are sealed. The discharge pipe 131 is fixed to the side surface of the side frame 75 facing the pressing roller 67, and there is a predetermined distance between the discharge pipe 131 and the pressing roller 67. A plurality of nozzles 132 are formed in the portion of the discharge pipe 131 facing the pressing roller 67 in the front-rear direction. The pump 135 is, for example, a diaphragm pump. The cleaning liquid C is, for example, water. The controller 120 supplies the cleaning liquid C from the tank 133 to the discharge pipe 131 by driving the pump 135.

[Unit Moving Mechanism]

The unit moving mechanism 62 (see FIG. 2) is configured to move the cleaning unit 61 between the cleaning position P1, the separation position P2 below the cleaning position P1 (see FIG. 7), and the attachment/detachment position P3 below the separation position P2 (see FIG. 6). The cleaning position P1 is a position where the web W wound around the pressing roller 67 is in contact with the conveying surface 34 of the resist roller 33, the separation position P2 is a position where the cleaning unit 61 is separated from the cleaning position P1, and the attaching/detaching position P3 is a position where the cleaning unit 61 can be attached/detached to/from the housing 10. At the cleaning position P1, the cleaning unit 61 and the web driving mechanism 63 (see FIG. 5) are connected, and at the separation position P2, the cleaning unit 61 and the web driving mechanism 63 are disconnected. The housing 10 includes a sensor (not shown) for detecting that the cleaning unit 61 is attached to the housing 10.

The unit moving mechanism 62 includes a rotatable support shaft 91 supported by the housing 10, a pair of front and rear swing arms 92 (only the rear side is shown) fixed to the support shaft 91, and a cleaning motor 94 connected to the support shaft 91 via a power transmission mechanism (not shown). The base end of the swing arm 92 is fixed to the support shaft 91, and a hook 93 for receiving the support pin 77 of the cleaning unit 61 is formed at the tip end of the swing arm 92. The hook 93 is a notch formed in an edge portion of the swing arm 92, and the support pin 77 of the cleaning unit 61 enters the hook 93, so that the cleaning unit 61 is supported by the pair of swing arms 92 and can rotate relative to the pair of swing arms 92.

As shown in FIG. 6, the unit moving mechanism 62 has a pair of front and rear guide portions 115 (only the rear side is shown) for guiding the cleaning unit 61 from the attachment/detachment position P3 to the cleaning position P1 (see FIG. 8). Each guide portion 115 is formed with a guide surface 116 in contact with the guide roller 78 of the cleaning unit 61. When the driving force is transmitted from the cleaning motor 94 to the support shaft 91, the swing arm 92 swings around the support shaft 91, and the cleaning unit 61 is positioned at the attachment/detachment position P3, the separation position P2, and the cleaning position P1. Further, the unit moving mechanism 62 includes a first sensor 95 and a second sensor 96 for detecting the position of the cleaning unit 61.

The first sensor 95 and the second sensor 96 are, for example, photo-interrupters, and output signals of different levels between when light is blocked and when light is not blocked. A pulse plate 97 having a plurality of slits formed radially at equal intervals is fixed to the output shaft of the cleaning motor 94. The first sensor 95 outputs a pulse signal whose level alternately changes due to the rotation of the pulse plate 97. On the pulse signal output from the first sensor 95, the controller 120 determines the rotation amount of the cleaning motor 94 based on the attachment/detachment position P3, and determines the position of the cleaning unit 61 from the determined rotation amount. The second sensor 96 is disposed at a position where the cleaning unit 61 blocks light when the cleaning unit 61 is located at the cleaning position P1, and outputs a first level detection signal when light is not blocked, and outputs a second level detection signal when light is blocked. The controller 120 determines that the cleaning unit 61 has moved to the cleaning position P1 when the detection signal output from the second sensor 96 changes from the first level to the second level.

A controller 120 is connected to the cleaning motor 94. The amount of rotation is fed back from the controller 120 to the cleaning motor 94, whereby the cleaning motor 94 is servo-controlled and the amount of movement of the cleaning unit 61 is adjusted. The first sensor 95 may be such a component that is able to detect the rotation amount of the cleaning motor 94, and the second sensor 96 may be such a component that is able to detect the cleaning unit 61 at the cleaning position P1. Therefore, the first sensor 95 and the second sensor 96 may be a photoreflector or the like.

[Web Driving Mechanism]

The web driving mechanism 63 (see FIG. 5) transmits a driving force to the cleaning unit 61 and intermittently supplies an unused portion of the web W to the nip region N2 between the conveying surface 34 of the resist roller 33 (see FIG. 2) and the pressing roller 67. As described above, the web driving mechanism 63 is connected to the cleaning unit 61 by positioning the cleaning unit 61 at the cleaning position P1, and transmits power to the cleaning unit 61. The web drive mechanism 63 includes a web solenoid 101 (solenoid actuator) as a drive source.

The tip end of the rod 102 integrated with the iron core is exposed from the upper portion of the web solenoid 101, and the rod 102 advances and retreats up and down in accordance with a drive command output from the controller 120. A swing lever 103 for converting the advancing/retreating movement of the rod 102 into the rotation movement is provided to the left of the web solenoid 101 to be adjacent to the web solenoid 101. The swing lever 103 is supported by the housing 10 via a support shaft 104 and is urged clockwise. The swing lever 103 is formed in an L-shape having a side lever 105 extending laterally from the support shaft 104 and a lower lever 106 extending downwardly from the support shaft 104. The tip end of the rod 102 is in contact with the lower surface of the side lever 105, and the lower end of the lower lever 106 includes the 1 detection piece 107.

The rear end of the support shaft 104 includes an output gear 108 that rotates integrally with the support shaft 104. A swing lever 103 is connected to the support shaft 104 via a one way clutch (not shown), and the support shaft 104 and the output gear 108 rotate when the swing lever 103 swings clockwise as the rod 102 retracts downward. On the other hand, when the swing lever 103 is swung counterclockwise by the upward projection of the rod 102, the support shaft 104 and the output gear 108 do not rotate. An input gear 79 of the cleaning unit 61 is connected to the output gear 108 via a plurality of transmission gears 111 and 112. The input gear 79 is connected to the winding roller 68 via a power transmission mechanism (not shown). Therefore, as shown in FIG. 5, only when the swing lever 103 swings clockwise, the winding roller 68 is driven to wind the web W. The winding direction of the web W is one direction, and in order to prevent the web W from being reversely wound or loosened, a braking mechanism (not shown) is provided to the feeding roller 66, and a one way clutch (not shown) is provided to the winding roller 68.

A third sensor 109 for detecting the detection piece 107 is provided below the lower lever 106. The third sensor 109 is, for example, a photo-interrupter. When the swing lever 103 swings clockwise, the first level detection signal is output because light is not blocked by the detection piece 107; and when the swing lever 103 swings counterclockwise, the second level detection signal is output because light is blocked by the detection piece 107. The third sensor 109 may be a photo-reflector or the like as long as it can detect the detection piece 107.

[Basic Operation of Cleaning Device]

Next, with reference to FIGS. 5 to 8, a basic operation of the cleaning device 60 (the cleaning unit 61's moving operation, cleaning operation, and winding operation of the web W) will be described.

[Moving Operation of Cleaning Unit]

When the cleaning unit 61 is attached to the housing 10, the cleaning unit 61 is positioned at the attachment/detachment position P3 (see FIG. 6). In the attachment/detachment position P3, the tip end of the swing arm 92 is directed downward, and the support pin 77 of the cleaning unit 61 is supported by the hook 93. Also, the guide roller 78 of the cleaning unit 61 is separated from the guide surface 116 of the guide portion 115.

When it is detected that the cleaning unit 61 is attached to the housing 10, the cleaning motor 94 is driven by a drive command from the controller 120, and the swing arm 92 fixed to the support shaft 91 swings counterclockwise. The support pin 77 of the cleaning unit 61 is pushed up by the hook 93 of the swing arm 92, and the guide roller 78 of the cleaning unit 61 rolls on the guide surface 116 of the guide portion 115, whereby the cleaning unit 61 moves upward from the attaching/detaching position P3. At this time, since the support pin 77 of the cleaning unit 61 can rotate relative to the hook 93 of the swing arm 92, the cleaning unit 61 can be smoothly lifted in accordance with the swing of the swing arm 92.

The controller 120 determines the position of the cleaning unit 61 based on the pulse signal output from the first sensor 95, and when it is determined that the cleaning unit 61 has reached the separation position P2, the controller 120 stops the driving of the cleaning motor 94 and positions the cleaning unit 61 at the separation position P2 (see FIG. 7). When the resist roller 33 is not cleaned, the controller 120 causes the cleaning unit 61 to stand by at the separation position P2.

When cleaning of the resist roller 33 is executed, the cleaning motor 94 is driven by a drive command from the controller 120, the swing arm 92 swings further counter-clockwise, and the cleaning unit 61 is positioned at the cleaning position P1 when the second sensor 96 detects the cleaning unit 61 (see FIG. 8). At this time, the cleaning unit 61 and the web driving mechanism 63 are connected (see FIG. 5).

[Cleaning Operation]

In the cleaning position P1, the resist roller 33 is rotated in the direction A in FIG. 8 in a state where the web W is pressed against the conveying surface 34 of the resist roller 33. The ink adhering to the conveying surface 34 is absorbed by the web W.

During cleaning of the resist roller 33 by the cleaning unit 61, the exciting current is continuously supplied from the controller 120 to the cleaning motor 94, so that downward swinging of the swing arm 92 is suppressed and the cleaning unit 61 is held at the cleaning position P1.

[Web Winding Operation]

When the winding of the web W is executed, the rod 102 of the web solenoid 101 is retracted by the drive command from the controller 120, whereby the swing lever 103 is swung clockwise, the swing lever 103 and the support shaft 104 are rotated together via the one way clutch, and the winding roller 68 is driven to wind the used portion of the web W by a predetermined amount.

[Control of Cleaning Device]

Next, referring to FIGS. 10A to 12B, control of the cleaning device 60 for cleaning the conveying surface 34 will be described. FIGS. 10A to 12B are front views showing a procedure for controlling the cleaning device 60. The cleaning of the conveying surface 34 may be performed at a timing when the image forming job is not executed.

In the initial state (see FIG. 10A), the cleaning unit 61 is located at the separation position P2. The controller 120 discharges the cleaning liquid C to the unused portion of the web W by using the cleaning liquid supply unit 130 in a state where the cleaning unit 61 is located at the separation position P2 (see FIG. 10B). The discharged cleaning liquid C is absorbed into the unused portion of the web W.

Figure 11A:
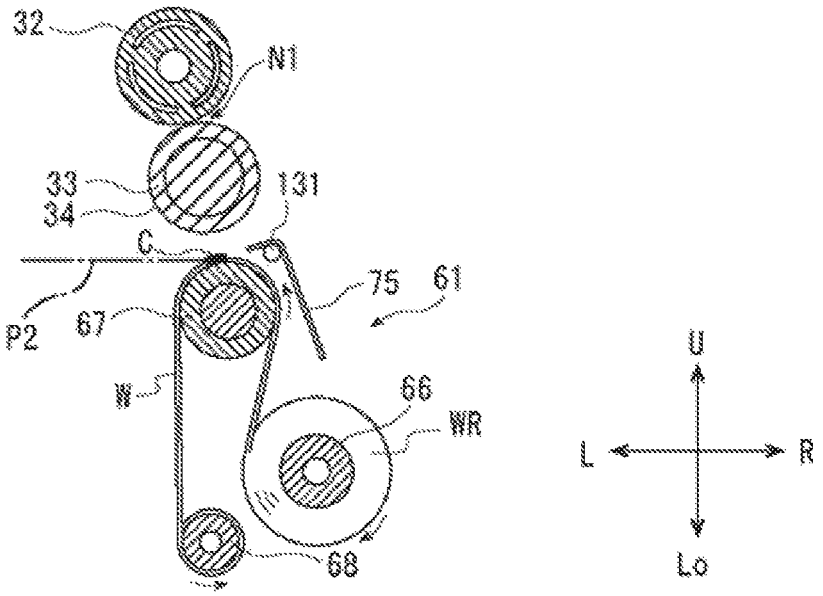
FIG. 11A is a front view showing a procedure for controlling the cleaning device.

Next, the controller 120 moves the unused portion to which the cleaning liquid C has been discharged, to a position facing the conveying surface 34 by using the web driving mechanism 63 (see FIG. 11A).

Figure 11B:
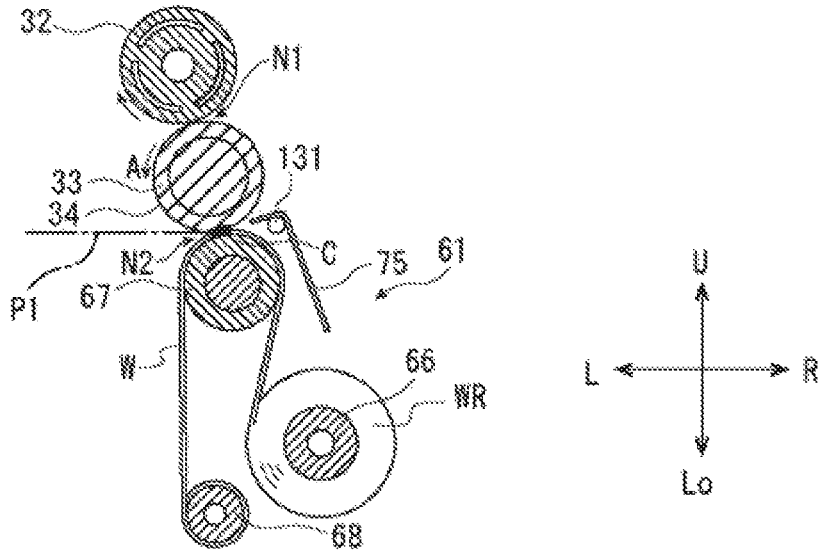
FIG. 11B is a front view showing a procedure for controlling the cleaning device.

Next, the controller 120 moves the cleaning unit 61 to the cleaning position P1 by using the unit moving mechanism 62 to form the nip region N2, and presses the unused portion to which the cleaning liquid C has been discharged against the conveying surface 34 (see FIG. 11B). The controller 120 rotates the resist roller 33 in the A direction to cause the conveying surface 34 rotate around, thereby to rub the conveying surface 34 against the unused portion in which the cleaning liquid C is discharged. By this operation, the ink is removed from the conveying surface 34. At this time, the cleaning liquid C may remain on the conveying surface 34.

Figure 12A:
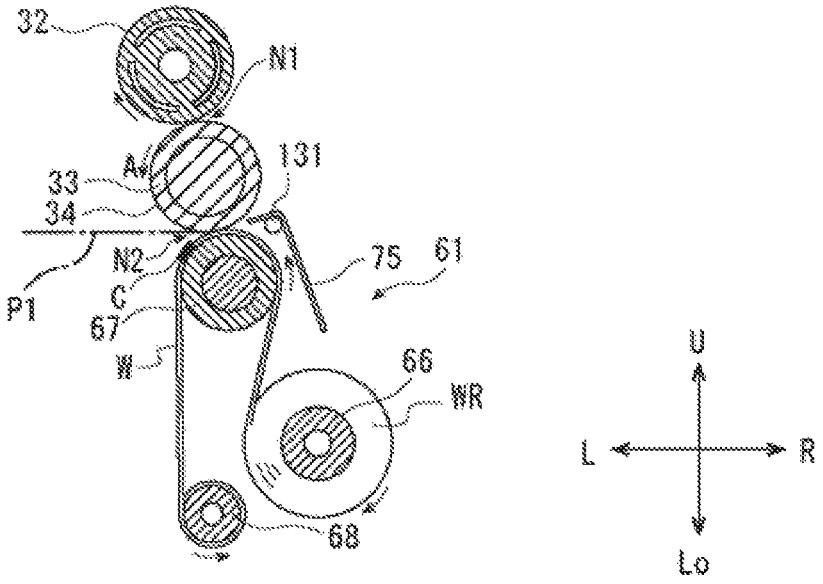
FIG. 12A is a front view showing a procedure for controlling the cleaning device.
Figure 12B:
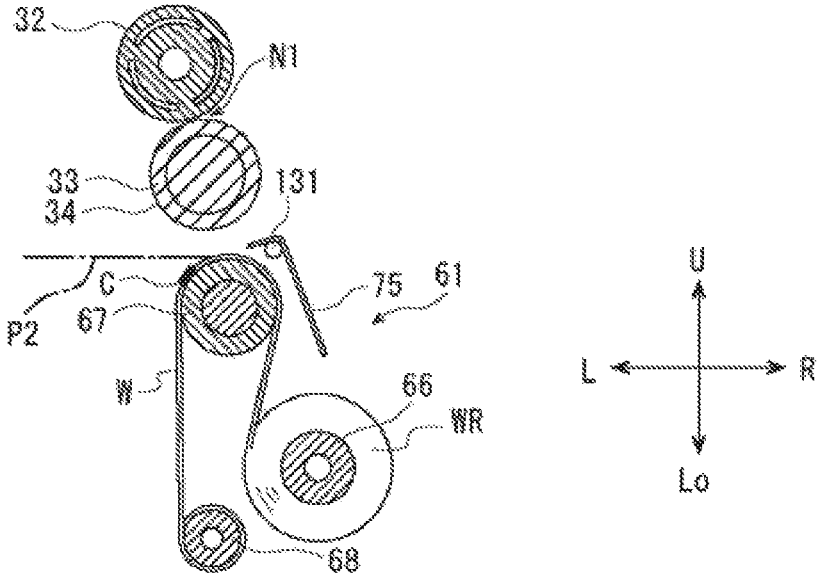
FIG. 12B is a front view showing a procedure for controlling the cleaning device.

Next, the controller 120 supplies the unused portion in which the cleaning liquid C is not discharged, to the nip region N2 by the web driving mechanism 63 (see FIG. 12A). The controller 120 continuously rotates the resist roller 33 in the A direction to rotate the conveying surface 34, thereby rubs the conveying surface 34 against the unused portion where the cleaning liquid C is not discharged. By this operation, the cleaning liquid C remaining on the conveying surface 34 is removed.

Finally, the controller 120 moves the cleaning unit 61 to the separation position P2 by using the unit moving mechanism 62 (see FIG. 12B), and stops the rotation of the resist roller 33.

According to the cleaning device 60 according to the present embodiment described above, since the controller 120 removes the ink from the conveying surface 34 by supplying the unused portion of the web W to which the cleaning liquid C has been supplied by the cleaning liquid supply unit 130 to the nip region N2 by using the web driving mechanism 63, and then removes the cleaning liquid C remaining on the conveying surface 34 by supplying the unused portion to which the cleaning liquid C has not been supplied, to the nip region N2 by using the web driving mechanism 63, the cleaning of the conveying surface 34 using the cleaning liquid C and the removal of the cleaning liquid C remaining on the conveying surface 34 can be performed with the one webs W.

Further, according to the cleaning device 60 of the present embodiment, since the cleaning liquid supply unit 130 includes the nozzle 132 for discharging the cleaning liquid C to the unused portion of the web W, the cleaning liquid C can be supplied to the web W with a simple configuration.

When the web W is pressed against the conveying surface 34, a resistance to the rotation of the resist roller 33 is generated, so that the conveying speed of the sheet S may be lowered. Further, since the magnitude of the resistance is different between the unused portion to which the cleaning liquid C has been supplied and the unused portion to which the cleaning liquid C has not been supplied, there is a possibility that the conveying speed may vary. Therefore, it is desirable that the cleaning of the conveying surface 34 is performed when the image forming job is not being executed or when the image forming job being executed is interrupted. In this case, during the cleaning of the conveying surface 34, there is downtime in which image formation is not performed. According to the cleaning device 60 according to the present embodiment, the controller 120 supplies the cleaning liquid C to the unused portion of the web W by using the cleaning liquid supply unit 130 in a state in which the cleaning unit 61 is moved to the separation position P2 by the unit moving mechanism 62. The unused portion to which the cleaning liquid C has been supplied is moved to a position facing the conveying surface 34 by the web driving mechanism 63, and the cleaning unit 61 is moved to the cleaning position P1 by the unit moving mechanism 62. The ink is removed from the conveying surface 34 by the unused portion supplied with the cleaning liquid C. Thereafter, the unused portion to which the cleaning liquid C has not been supplied is supplied to the nip region N2 by the web driving mechanism 63, and the cleaning liquid C remaining on the conveying surface 34 is removed. Thereafter, the cleaning unit 61 is moved to the separation position P2 by the unit moving mechanism 62, which minimizes the downtime. 2

The above embodiment may be modified as follows.

In the above embodiment, the cleaning device 60 removes the ink adhering to the resist roller 33, but the cleaning device 60 may be configured to remove the ink adhering to the conveying members other than the resist roller 33. The conveying members other than the resist roller 33 are, for example, a first conveying belt 45, a second conveying belt 51, a roller and a belt provided in the decurling device 54, a conveying roller provided in the second conveying path 22 and the third conveying path 23, and a reversing roller 26. Among these, ink may be transferred from the sheet S to the conveying members provided in the first conveying belt 45, the second conveying belt 51, the decurling device 54, and the second conveying path 22 even in single-sided printing, so that the cleaning unit 61 may be moved from the separation position P2 to the cleaning position P1 even in single-sided printing.

In the above embodiment, the pressing roller 67 is shown as an example of the web pressing section, but the web pressing section may be a member (not shown) that does not rotate following the winding of the web W. In this case, the surface of the member is preferably made of a material having a low friction coefficient, such as fluororesin.

Although the discharge pipe 131 is fixed to the side frame 75 in the above embodiment, the discharge pipe 131 may be able to approach and separate from the pressing roller 67. For example, a solenoid actuator (not shown) for moving the discharge pipe 131 to the left and right is provided on the support frames 72 and 73, and when the discharge pipe 131 moves to the right, the discharge pipe 131 is separated from the unused portion of the web W, and when the discharge pipe 131 moves to the left, the discharge pipe 131 comes into contact with the unused portion, and the cleaning liquid C is discharged to the unused portion while the discharge pipe 131 is in contact with the unused portion. According to this configuration, scattering of the cleaning liquid C can be reduced.

What is claimed is:

1. A cleaning device comprising:

a cleaning unit that includes a web pressing section for pressing a web for removing an ink adhering to a conveying surface of a conveying member that conveys a sheet on which the ink has been discharged, against the conveying surface;

a cleaning liquid supply unit for supplying a cleaning liquid to an unused portion of the web;

a web driving mechanism for supplying the unused portion to a nip region between the web pressing section and the conveying surface; and a controller that supplies the unused portion to which the cleaning liquid has been supplied by the cleaning liquid supply unit to the nip region by using the web driving mechanism thereby removing the ink from the conveying surface, and subsequently supplies the unused portion to which the cleaning liquid has not been supplied to the nip region by using the web driving mechanism thereby removing the cleaning liquid remaining on the conveying surface.

2. The cleaning device according to claim 1, wherein the cleaning liquid supply unit includes a nozzle for discharging the cleaning liquid to the unused portion.

3. The cleaning device according to claim 1, further comprising:

a unit moving mechanism for moving the cleaning unit to a cleaning position where the web is pressed against the conveying surface and a separation position where the web is separated from the conveying surface, wherein the controller supplies the cleaning liquid to the unused portion by using the cleaning liquid supply unit in a state in which the cleaning unit is moved to the separation position by the unit moving mechanism, moves the unused portion to which the cleaning liquid has been supplied to a position facing the conveying surface by the web driving mechanism, moves the cleaning unit to the cleaning position by using the unit moving mechanism thereby removing the ink from the conveying surface by the unused portion to which the cleaning liquid has been supplied, subsequently supplies the unused portion to which the cleaning liquid has not been supplied to the nip region by using the web driving mechanism thereby removing the cleaning liquid remaining on the conveying surface, and thereafter moves the cleaning unit to the separation position by using a unit moving mechanism.

4. An ink jet recording apparatus comprising:

an image forming unit for forming an image on a sheet by discharging ink; and the cleaning device according to claim 1.

* * * * *